US008435361B2

(12) United States Patent
Gaag et al.

(10) Patent No.: US 8,435,361 B2
(45) **Date of Patent: *May 7, 2013**

(54) COPPER-ZINC ALLOY FOR A VALVE GUIDE

(75) Inventors: Norbert Gaag, Lauf (DE); Alexander Dehnelt, Nürnberg (DE)

(73) Assignee: Diehl Metall Stiftung & Co. KG, Roethenbach (DE)

( * ) Notice: Subject to any disclaimer, the term of this patent is extended or adjusted under 35 U.S.C. 154(b) by 324 days.

This patent is subject to a terminal disclaimer.

(21) Appl. No.: 11/809,575

(22) Filed: Jun. 1, 2007

(65) Prior Publication Data

US 2007/0227631 A1 Oct. 4, 2007

Related U.S. Application Data

(63) Continuation of application No. PCT/EP2005/012824, filed on Dec. 1, 2005.

(30) Foreign Application Priority Data

Dec. 2, 2004 (DE) ..... 10 2004 058 318

(51) Int. Cl.
*C22C 9/04* (2006.01)

(52) U.S. Cl.
USPC ..... 148/433; 148/434; 420/471; 420/475; 420/476; 420/478; 420/480; 123/188.3

(58) Field of Classification Search ..... 148/433, 148/434; 420/471, 475, 476, 478, 480; 123/188.3
See application file for complete search history.

(56) References Cited

U.S. PATENT DOCUMENTS

| | | | |
|---|---|---|---|
| 3,773,504 | A | 11/1973 | Niimi et al. |
| 4,676,848 | A | 6/1987 | Ruchel et al. |
| 4,851,191 | A | 7/1989 | Lee et al. |

FOREIGN PATENT DOCUMENTS

| | | | |
|---|---|---|---|
| DE | 1 558 470 | A1 | 3/1970 |
| DE | 2 145 710 | A1 | 7/1972 |
| DE | 29 19 478 | C2 | 11/1980 |
| DE | 270 931 | A1 | 8/1989 |
| GB | 2 011 947 | A | 7/1979 |
| GB | 2 049 727 | A | 12/1980 |
| JP | 56-127741 | A | 10/1981 |

*Primary Examiner* — Sikyin Ip

(74) *Attorney, Agent, or Firm* — Laurence A. Greenberg; Werner H. Stemer; Ralph E. Locher

(57) ABSTRACT

A novel copper-zinc alloy is particularly suited for a valve guide. The copper-zinc alloy contains 59 to 73% copper, 2.7 to 8.3% manganese, 1.5 to 6% aluminum, 0.2 to 4% silicon, 0.2 to 3% iron, 0 to 2% lead, 0 to 2% nickel, 0 to 0.2% tin, remainder zinc and inevitable impurities.

3 Claims, No Drawings

COPPER-ZINC ALLOY FOR A VALVE GUIDE

CROSS-REFERENCE TO RELATED APPLICATIONS

This is a continuation, under 35 U.S.C. §120, of copending international application PCT/EP2005/012824, filed Dec. 1, 2005, which designated the United States; this application also claims the priority, under 35 U.S.C. §119, of German patent application DE 10 2004 058 318.8, filed Dec. 2, 2004; the prior applications are herewith incorporated by reference in their entirety.

BACKGROUND OF THE INVENTION

Field of the Invention

The invention relates to a copper-zinc alloy that is particularly suited for use in a valve guide.

Copper-zinc alloys or sintered steel alloys are used for a valve guide in an internal combustion engine. However, the properties of the Cu—Zn alloys no longer meet the demands imposed on a valve guide which is to be used in the new direct-injected FSI engines (FSI: fuel stratified injection). In these engines, the working temperature of the valve guides may reach and exceed 300° C. The copper-zinc alloys which are currently used, however, soften at these temperatures. A similar disadvantageous effect is also observed in sintered steel alloys. Sintered steel alloys likewise soften at temperatures above 300° C., and in addition the hardness varies considerably. Moreover, the outlay involved in producing sintered steel alloys is high, on account of the powder metallurgy production process.

SUMMARY OF THE INVENTION

It is accordingly an object of the invention to provide a copper-zinc alloy for such high-temperature use which overcomes the above-mentioned disadvantages of the heretofore-known devices and methods of this general type and which provides a copper-zinc alloy that is suitable for use as a valve guide, wherein the copper-zinc alloy satisfies the demands imposed on materials for valve guides, in particular at elevated temperatures, while being simple to produce.

With the foregoing and other objects in view there is provided, in accordance with the invention, a valve guide that is formed of a specially formulated copper-zinc alloy. The alloy for the valve guide comprises 59 to 73% copper, 2.7 to 8.3% manganese, 1.5 to 6% aluminum, 0.2 to 4% silicon, 0.2 to 3% iron, 0 to 2% lead, 0 to 2% nickel, 0 to 0.2% tin, remainder zinc and inevitable impurities.

The % (percent) indications in this text refer to percent by weight (wt. %).

Therefore, the invention specifies a new use of a copper-zinc alloy. A similar alloy as described in the commonly assigned German patent DE 29 19 478 C2 (cf. GB 2 049 727 A) is used as a synchronizer ring alloy and has a high coefficient of friction. Hitherto, a high coefficient of friction has been considered an impediment to using a material as a valve guide, since this use requires the frictional stresses to be as low as possible.

In addition to a good thermal stability, it has been found that the copper-zinc alloy described has a surprisingly high hot strength, which in combination with its good wear resistance is the property which actually allows it to be used as a valve guide. This surprising combination of materials properties offers the option of using the known alloy in a new way as a valve guide. Use as a valve guide in modern engines requires a combination of a high thermal stability at over 300° C. and a good wear resistance, which is required on account of transverse forces acting on the valve tappets. On account of these otherwise excellent properties, the impact of the high coefficient of friction can be disregarded. Therefore, the invention overcomes a prejudice which has hitherto been commonly held in the specialist field.

The demand for successful and easy production is taken into account by the fact that the valve guides can be produced in rod form by semi-continuous or fully continuous casting, extrusion and drawing, i.e. by hot and cold forming.

The alloy has a microstructure which includes an α solid solution component and a β solid solution component.

In an advantageous refinement, the copper-zinc alloy for the use as a valve guide comprises 70 to 73% copper, 6 to 8% manganese, 4 to 6% aluminum, 1 to 4% silicon, 1 to 3% iron, 0.5 to 1.5% lead, 0 to 0.2% nickel, 0 to 0.2% tin, remainder zinc and inevitable impurities.

The microstructure of the refined alloy produced in accordance with the above-noted German patent DE 29 19 478 C2 consists of an alpha and β solid solution matrix comprising up to 60 to 85% α phase, wherein the body centered cubic β phase represents the base matrix, in which the face centered cubic α phase is distributed predominantly in finely dispersed form. The microstructure may also contain hard intermetallic compounds, for example iron-manganese silicides. The alpha phase determines the stability of the alloy.

Valve guides made from the novel alloy have a surprisingly high wear resistance, which is even higher than that of sintered steel. In particular the dry-friction wear in valve guides made from said alloy allows them to be used in engines which require "purer" fuels, i.e. lead-free of sulfur-free fuels (or ultra-low sulfur), since on account of the absence of these additives there is no need for an additional wear-reducing effect. This is particularly advantageous especially at temperatures around 300° C., the working temperature of the valve guides in FSI engines.

A further advantage of the use of this alloy as a valve guide is that a stable hardness level is achieved in the desired working range above 300° C., since softening of the alloy only occurs at temperatures above 430° C., whereas the softening of copper-zinc alloys which have been used hitherto begins as early as 150° C. The associated drop in hardness occurs starting from 150° C., and the drop in hardness of sintered steel alloys commences from 300° C.

In a preferred alternative, the invention claims the use of a copper-zinc alloy, wherein the alloy comprises 69.5 to 71.5% copper, 6.5 to 8% manganese, 4.5 to 6% aluminum, 1 to 2.5% silicon, 1 to 2.5% iron, 0.5 to 1% lead, 0 to 0.2% nickel, 0 to 0.2% tin, remainder zinc and inevitable impurities.

The microstructure of the alloy produced in the customary way includes an α and β solid solution matrix comprising up to 80% alpha phase distributed in finely dispersed form. It may also include hard intermetallic compounds, for example Fe—Mn silicides.

The use of said alloy as a valve guide is particularly advantageous since it has a hot tensile strength which is double that of conventional copper-zinc alloys which have hitherto been used as valve guides. Further advantageous properties include a high softening temperature, a high strength and a high wear resistance.

For valve guides, it is advantageous to use a copper-zinc alloy wherein the alloy comprises 60 to 61.5% copper, 3 to 4% manganese, 2 to 3% aluminum, 0.3 to 1% silicon, 0.2 to 1% iron, 0 to 0.5% lead, 0.3 to 1% nickel, 0 to 0.2% tin, remainder zinc and inevitable impurities.

The microstructure of said alloy, produced in a corresponding way, includes a base mass of β solid solution, in which α precipitations in needle and ribbon form are embedded. The microstructure may also include randomly dispersed manganese-iron silicides.

Valve guides made from this alloy have a high wear resistance which is even significantly higher than that of sintered steel. In particular the dry-friction wear in valve guides made from said alloy allows them to be used in engines which require "purer" fuels, i.e. lead-free or sulfur-free fuels, since the absence of these additives means that there is no need for an additional wear-reducing effect. This is particularly advantageous especially at temperatures around 300° C., the working temperature of the valve guides in FSI engines.

Further properties of said alloy which are advantageous for its use as a valve guide include a high softening temperature and a high hot tensile strength.

In an advantageous refinement, a copper-zinc alloy which additionally comprises up to 0.1% of at least one of the elements chromium, vanadium, titanium or zirconium is used for valve guides.

The addition of these elements to the copper-zinc alloy has a grain-refining action.

Furthermore, the copper-zinc alloy as used for a valve guide may additionally comprise at least one of the following elements in the concentration of ≦0.0005% boron, ≦0.03% antimony, ≦0.03% phosphorus, ≦0.03% cadmium, ≦0.05% chromium, ≦0.05% titanium, ≦0.05% zirconium, ≦0.05% cobalt.

Other features which are considered as characteristic for the invention are set forth in the appended claims.

Although the invention is illustrated and described herein as embodied in novel use of a copper-zinc alloy, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific examples.

DETAILED DESCRIPTION OF THE INVENTION

A number of exemplary embodiments are explained in more detail on the basis of the following description and with reference to Table 1.

At present, sintered steel and copper-zinc alloys having approximately the following composition: 56 to 60% copper, 0.3 to 1% lead, 0.2 to 1.2% iron, 0 to 0.2% tin, 0.7 to 2% aluminum, 1 to 2.5% manganese, 0.4 to 1% silicon, remainder zinc and inevitable impurities, are used as material for valve guides which are subject to relatively low thermal stresses. In the text which follows, an alloy of this type is referred to as a standard alloy. Alloy 1 corresponds to a first embodiment of the alloy according to the invention (cf. claims 2-4), and alloy 2 corresponds to a second embodiment of the novel alloy (cf. claims 5, 6).

The softening properties of the various materials were tested up to a temperature of 500° C. These tests showed that the standard alloy for valve guides has a significant and continuous decrease in its hardness from 195 HV50 to just 150 HV50 starting from a temperature of just 100° C. In the case of sintered steel, a drastic decrease in hardness from 195 to the low level of 130 HV50 occurs in the relevant temperature range above 300° C., with the hardness fluctuating up and down discontinuously as the temperature increases. By contrast, alloy 2 has a hardness which is approximately 10% higher (224 HV50), which only drops to about 170 HV50 above 350° C. The hardnesses of sintered steel at room temperature are only reached above 450° C. When compared with standard alloy, the hardnesses of alloy 2 are always well above those of the standard alloy. By contrast, alloy 1 has a significant increase in hardness, from 224 to 280 HV50, as the temperature rises up to 350° C. Compared to the sintered steel, alloy 1 has a hardness which is higher by 140 HV50. Therefore, the hardness maximum of alloy 1 lies at the temperatures which correspond to the working temperature of valve guides in FSI engines.

The higher hardness of alloys 1 and 2 compared to the materials which are customarily used is attributable on the one hard to the higher starting hardness and on the other hand to further hardening effects.

The electrical conductivity can be used as a measure of the thermal conductivity. A high value represents good thermal conductivity. The electrical conductivity of the standard alloy is 11 m/Ωmm$^2$. Alloy 2 has good electrical conductivity of 7.5 m/Ωmm$^2$, which is only about a quarter lower than that of the standard alloy. The electrical conductivity of alloy 1 is 4.6 m/Ωmm$^2$. This represents an electrical conductivity or heat dissipation which is approximately 48% higher than that of sintered steel (3.1 m/Ωmm$^2$). Therefore, the dissipation of heat of alloys 1 and 2 is significantly better than that of sintered steel.

The wear properties were tested with and without lubricant. With lubricant, sintered steel has the highest wear resistance (2500 km/g). Alloy 1 likewise has an excellent wear resistance of 1470 km/g, which is higher by more than a factor of 10 than the wear resistance of the standard alloy, at 126 km/g. The wear resistance of alloy 2 with lubricant is of a similar order of magnitude (94 km/g).

However, with regard to the wear properties without lubricant, it has been found that alloys 1 and 2 have significant advantages over sintered steel and the standard alloy. Sintered steel has a wear of 312 km/g, which approximately corresponds to the wear properties of the standard alloy, at 357 km/g. The dry wear properties of alloy 2, at 417 km/g, are significantly better than those of the standard alloy and sintered steel. In other words, the wear is significantly lower. At 625 km/g, alloy 1 even has a wear resistance which is twice as high as that of sintered steel. The low dry-friction wear makes alloys 1 and 2 of particular interest, since on account of the increasing purity of the fuels, i.e. their freedom from lead or sulfur, imposed by the engine, the wear-reducing effect of what is known as the "blow by", i.e. the lubrication provided by the fuel itself, in which in future the additive levels will be reduced, is absent.

The hot tensile strength was determined using tensile tests at 350° C. The hot tensile strength of the standard alloy is 180 N/mm$^2$. By comparison, that of alloy 1 is twice as high (384 N/mm$^2$). Alloy 2 has a hot tensile strength which is approximately 35% higher than that of the standard alloy, at 243 N/mm$^2$.

Alloy 1 and alloy 2 can preferably be produced by semi-continuous or fully continuous casting, extrusion, drawing and straightening.

Alloy 2 and in particular alloy 1 have clear advantages over the previous standard alloy used as a valve guide alloy and also compared to sintered steel. These advantages relate to the hot tensile strength, the softening temperature, the strength and the wear resistance. Furthermore, the conductivity is also sufficient, and consequently alloys 1 and 2 represent a considerable improvement for use as a valve guide, since these alloys satisfy the demands imposed on the material at the high operating temperatures used in the new generation of engines.

Table 1 below shows the material properties of a standard Cu—Zn alloy, a sintered steel alloy (standard alloy), in comparison with the novel alloy 1 and the novel alloy 2.

| Property | Standard alloy | Alloy 1 | Alloy 2 |
|---|---|---|---|
| Electrical conductivity (m/Ωmm2) | 11 | 4.6 | 7.5 |
| Hardness (HV50) cold-formed (10%) | 197 | 224 | 224 |
| Dry wear (km/g) | 357 | 625 | 417 |
| Lubricated wear (km/g) | 126 | 1470 | 94 |
| Softening temperature 10% cold-formed (° C.) | 310 | 480 | 430 |
| Hot tensile strength at 350° C. (N/mm2) | 173 | 350 | 232 |

The invention claimed is:

1. A valve guide formed of a copper-zinc alloy, the alloy consisting of, in percent by weight: 60 to 61.5% copper; 6.0 to 8.0% manganese; 2 to 3% aluminum; 0.3 to 1% silicon; 0.2 to 1% iron; 0 to 0.5% lead; 0.3 to 1% nickel; 0 to 0.2% tin; and a remainder zinc and inevitable impurities; said alloy formed into a valve guide.

2. The valve guide according to claim 1, wherein the alloy consists of: 60 to 61.5% copper; 6.0 to 8.0% manganese; 2 to 3% aluminum; 0.3 to 1% silicon; 0.2 to 1% iron; an amount of lead; 0.3 to 1% nickel; an amount of tin; and remainder zinc and inevitable impurities.

3. A valve guide formed of a copper-zinc alloy, the alloy consisting of, in percent by weight: 60 to 61.5% copper; 6.0 to 8.3% manganese; 2 to 3% aluminum; 0.3 to 1% silicon; 0.2 to 1% iron; 0 to 0.5% lead; 0.3 to 1% nickel; 0 to 0.2% tin; and remainder zinc and inevitable impurities, wherein said alloy formed into a valve guide has a hot tensile strength at 350° C. of at least 200 $N/mm^2$.

* * * * *